US007700249B2

(12) United States Patent
Lin et al.

(10) Patent No.: US 7,700,249 B2
(45) **Date of Patent: *Apr. 20, 2010**

(54) SINGLE LAYERED PHOTOCONDUCTORS

(75) Inventors: Liang-Bih Lin, Rochester, NY (US); Daniel V. Levy, Rochester, NY (US); Jin Wu, Webster, NY (US); Edward C. Savage, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 372 days.

This patent is subject to a terminal disclaimer.

(21) Appl. No.: 11/796,933

(22) Filed: Apr. 30, 2007

(65) Prior Publication Data

US 2008/0268360 A1 Oct. 30, 2008

(51) Int. Cl.
*G03G 5/06* (2006.01)

(52) U.S. Cl. ..... 430/58.25; 430/56; 430/58.8; 430/59.4

(58) Field of Classification Search ..... 430/56, 430/58.8, 59.4
See application file for complete search history.

(56) References Cited

U.S. PATENT DOCUMENTS 4,265,990 A 5/1981 Stolka et al.
4,647,411 A * 3/1987 Kitao et al. ..... 552/244
4,882,250 A * 11/1989 Liu et al. ..... 430/58.15
5,153,094 A 10/1992 Kazmaier et al.
5,166,339 A 11/1992 Duff et al.
5,189,155 A 2/1993 Mayo et al.
5,189,156 A 2/1993 Mayo et al.
5,473,064 A 12/1995 Mayo et al.
5,482,811 A * 1/1996 Keoshkerian et al. ..... 430/135
5,521,306 A 5/1996 Burt et al.
6,376,141 B1 4/2002 Mishra et al.
6,713,220 B2 3/2004 Graham et al.
6,913,863 B2 7/2005 Wu et al.
7,037,631 B2 5/2006 Wu et al.
2003/0148201 A1* 8/2003 Kodera et al. ..... 430/74
2004/0126685 A1* 7/2004 Horgan et al. ..... 430/58.3
2006/0024100 A1* 2/2006 Ohta et al. ..... 399/350
2006/0029872 A1* 2/2006 Qi et al. ..... 430/58.8
2006/0105254 A1 5/2006 Wu et al.

OTHER PUBLICATIONS

See the "Cross Reference to Related Applications" on p. 1 of the Specification Being Filed Concurrently.
Jin Wu et al., U.S. Appl. No. 11/472,766 on Titanyl Phthalocyanine Photoconductors, file Jun. 22, 2006.

* cited by examiner

*Primary Examiner*—Mark F Huff
*Assistant Examiner*—Peter L Vajda
(74) *Attorney, Agent, or Firm*—E. O. Palazzo

(57) ABSTRACT

A photoconductor that includes a supporting substrate, and an active layer in contact with the substrate, and which active layer contains a photogenerating pigment of a hydroxygallium phthalocyanine, at least one charge transport component, and a mixture of a metal oxide and a chelating agent, where the phthalocyanine is, for example, prepared by hydrolyzing a gallium halide phthalocyanine.

26 Claims, No Drawings

SINGLE LAYERED PHOTOCONDUCTORS

CROSS REFERENCE TO RELATED APPLICATIONS

Illustrated in copending U.S. application Ser. No. 11/796,900, U.S. Publication No. 20080268358, filed Apr. 30, 2007, the disclosure of which is totally incorporated herein by reference, is a member comprised of a supporting substrate, and a layer in contact with the substrate, and which layer is comprised of a titanyl phthalocyanine pigment, at least one charge transport component, and a metal oxide having attached thereto a chelating agent of a tetrafluorodihydroxyanthraquinone, and wherein said titanyl phthalocyanine is prepared by dissolving a Type I titanyl phthalocyanine in a solution comprising a trihaloacetic acid and an alkylene halide; adding the mixture comprising the dissolved Type I titanyl phthalocyanine to a solution comprising an alcohol and an alkylene halide thereby precipitating a Type Y titanyl phthalocyanine; and treating the Type Y titanyl phthalocyanine with a monohalobenzene.

Illustrated in copending U.S. application Ser. No. 11/796,931, U.S. Publication No. 20080268359, filed Apr. 30, 2007, the disclosure of which is totally incorporated herein by reference, is a photoconductor comprised of a supporting substrate, and a layer in contact with the substrate, and which layer is comprised of at least one photogenerating pigment, at least one charge transport component, and a metal oxide having attached thereto a chelating agent of a tetrafluorodihydroxyanthraquinone, U.S. Pat. No. 7,485,398, the disclosure of which is totally incorporated herein by reference, on Titanyl Phthalocyanine Photoconductors.

High photosensitivity titanyl phthalocyanines are illustrated in copending U.S. application Ser. No. 10/992,500, U.S. Publication No. 20060105254 referenced herein. These and other similar high sensitivity, and more specifically, hydroxygallium phthalocyanine and a high photosensitivity titanyl phthalocyanine can be selected for the photoconductors of the present disclosure.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

A number of the components of the above cross referenced applications and the above recited patent, such as the supporting substrates, resin binders, antioxidants, charge transport components, chelating agents, hole blocking layer components, adhesive layers, and the like may be selected for the photoconductor and imaging members of the present disclosure in embodiments thereof.

BACKGROUND

This disclosure is generally directed to imaging members, photoreceptors, photoconductors, and the like. More specifically, the present disclosure is directed to single layered flexible, belt imaging members, or devices comprised of an optional supporting medium like a substrate, and thereover a single layer comprised of a photogenerating pigment or pigments, a charge transport component or components, and a metal oxide having applied thereto a chelating agent of, for example, an anthraquinone like a tetrafluorodihydroxyanthraquinone, an optional adhesive layer, an optional hole blocking or undercoat layer, and an optional overcoating layer. In embodiments, there is selected as the photogenerating pigment a titanyl phthalocyanine or a hydroxygallium phthalocyanine prepared as illustrated herein, and where these pigments are stable especially in the presence of solvents, such as tetrahydrofuran (THF), which solvent is selected to provide for adequate specific component solubility in a binder present, such as a polycarbonate, and where charge leakage is reduced by the use of a suitable chelating agent. More specifically, there is selected in embodiments for the preparation of the photogenerating dispersion a mixture of THF and a halobenzene like monochlorobenzene.

In embodiments of the present disclosure there is selected as the photogenerating pigment a hydroxygallium phthalocyanine, especially hydroxygallium phthalocyanine Type V prepared, for example, as disclosed in U.S. Pat. No. 5,482,811, the disclosure of which is totally incorporated herein by reference, which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water; concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs. Also, the hydroxygallium phthalocyanine can be prepared as disclosed in U.S. Pat. No. 5,473,064, the disclosure of which is totally incorporated herein by reference, whereby a pigment precursor Type I chlorogallium phthalocyanine is prepared by reaction of gallium chloride in a solvent, such as N-methylpyrrolidone, present in an amount of from about 10 parts to about 100 parts, and more specifically, about 19 parts with 1,3-diiminoisoindolene ($DI^3$) in an amount of from about 1 part to about 10 parts, and more specifically, about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid, and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and more specifically, about 24 hours.

More specifically, a preparation process for obtaining Type V hydroxygallium phthalocyanine comprises the formation of a precursor gallium phthalocyanine with, for example, an X-ray powder diffraction trace having peaks at Bragg angles of 7.6, 8.1, 9.7, 16.0, 18.4, 19.2, 19.9, 24.7, 25.7 and 26.2, and the highest peak at 8.1 degrees 2θ, prepared by the reaction of 1,3-diiminoisoindolene with gallium acetylacetonate in a suitable solvent, such as N-methylpyrrolidone, or halonaphthalene like 1-chloronaphthalene, quinoline, and the like; hydrolyzing the precursor by dissolving in a strong acid and then reprecipitating the resulting dissolved pigment in aqueous ammonia, thereby forming Type I hydroxygallium phthalocyanine; and admixing the Type I formed with a hydrophobic solvent of, for example, hexanes, including 1-hexanes and/or isomers thereof, heptane, cyclohexane, cyclopentane or esters, such as propylacetate, butylacetate, or ketones, such as methyl isobutyl ketone, methyl isoamyl ketone, or toluene, and thereafter azeotropically removing water therefrom. Yet more specifically, the process comprises the formation of a precursor prepared by the reaction of 1 part gallium acetylacetonate with from about 1 part to about 10 parts, and more specifically, about 4 parts 1,3-diimiinoisoindolene in a solvent, such as quinoline, chloronaphthalene, or N-methylpyrrolidone, in an amount of from about 10 parts to about 100 parts, and more specifically, about 19 parts, for each part of gallium acetylacetonate that is used, to provide a pigment precursor gallium phthalocyanine, which is subsequently washed with a component, such as dimethylformamide to provide the precursor gallium phthalocyanine as determined by X-ray powder diffraction with an X-ray powder diffraction trace having peaks at Bragg angles of 7.6, 8.1, 9.7, 16.0, 18.4, 19.2, 19.9, 24.7, 25.7, and 26.2, and the highest peak at 8.1 degrees 2θ; dissolving 1 weight part of the resulting gallium phthalocyanine in concentrated, about 94 percent, sulfuric acid in an amount of from about 1 weight part to about 100 weight parts, and in an embodiment about 5 weight parts, by stirring the pigment precursor gallium phthalocyanine in the acid for an effective period of time, from about 30 seconds to about 24 hours, and in an embodiment about 2 hours at a temperature of from about 0° C. to about 75° C., and more specifically, about 40° C., in air or under an inert atmosphere, such as argon or nitrogen; adding the resulting mixture to a stirred organic solvent in a dropwise manner at a rate of about 0.5 milliliter per minute to about 10 milliliters per minute, and in an embodiment about 1 milliliter per minute to a nonsolvent, which can be a mixture comprised of from about 1 volume part to about 10 volume parts and more specifically, about 4 volume parts of concentrated aqueous ammonia solution (14.8N), and from about 1 volume part to about 10 volume parts, and more specifically, about 7 volume parts of water for each volume part of acid like sulfuric acid that was used, which solvent mixture was chilled to a temperature of from about −25° C. to about 10° C., and in an embodiment about −5° C. while being stirred at a rate sufficient to create a vortex extending to the bottom of the flask containing the solvent mixture; isolating the resulting blue pigment by, for example, filtration; and washing the hydroxygallium phthalocyanine product obtained with deionized water by redispersing and filtering from portions of deionized water, which portions are from about 10 volume parts to about 400 volume parts, and in an embodiment about 200 volume parts for each weight part of precursor pigment gallium phthalocyanine which was used. The product, a dark blue solid, was confirmed to be Type I hydroxygallium phthalocyanine on the basis of its X-ray diffraction pattern having major peaks at 6.9, 13.1, 16.4, 21.0, 26.4, and the highest peak at 6.9 degrees 2θ. The Type I hydroxygallium phthalocyanine product obtained as a wet cake, approximately 10 percent by weight pigment and 90 percent by weight water, can then be dried by azeotropically distilling off water with a hydrophobic solvent, such as hexane, of from 1 part to 30 parts of wet cake to 100 parts by volume of solvent, more specifically, 20 parts. Water is removed by heating to the azeotrope boiling point and continued until the distillate temperature reaches the boiling point of the hydrophobic solvent. The advantages of this method are, for example, that drying of the pigment consumes from 1 to 5 hours versus, for example, greater than 24 hours under vacuum by conventional means. Furthermore, the particle size remains in the range of about 150 to about 300 nanometers as measured by TEM. Also, in embodiments the obtained crude hydroxy gallium phthalocyanine can be washed to reduce the sulfur content. The sulfur reduction washes can be accomplished on either the Type I hydroxygallium phthalocyanine or on the Type V hydroxy gallium phthalocyanine product. In the situation with sulfur reduction of the Type I hydroxygallium phthalocyanine, 1 part pigment to 10 parts pigment, more specifically, 5 parts pigment are redispersed in a hydrophilic solvent of, for example, N-methylpyrrolidone, tetrahydrofuran, acetone, methanol, isopropanol and N—N-dimethylformamide, from 100 parts solvent to 1,000 parts solvent, and more specifically, 300 parts. Subsequently, concentrated ammonium hydroxide (38 percent $NH_4OH$) solution is added, from 50 parts to 600 parts, and more specifically, 100 parts. The resulting dispersion is stirred for from 1 minute to 24 hours, and more specifically, 2 hours, and then filtered through a ceramic Buchner funnel using GFF/F filter paper. The organic solvent/aqueous base washing is repeated 1 to 4 times, and more specifically, 1, and then the Type I hydroxygallium phthalocyanine is washed with deionized water until the filtrate conductivity is below from about 0.1 to about 20 milliSiemens per centimeter squared. The wet Type I hydroxygallium phthalocyanine pigment can than be dried azeotropically, and then converted to Type V hydroxygallium phthalocyanine by stirring in the solvent N,N-dimethylformamide 1 part Type I pigment to 15 parts solvent.

The hydroxygallium photogenerating pigment essentially free of chlorine can also be can be prepared by the conversion of Type I hydroxygallium phthalocyanine to Type V hydroxygallium phthalocyanine wherein the Type I hydroxygallium phthalocyanine is prepared by the hydrolysis of the dimer 1,2-di(oxogallium phthalocyaninyl)ethane. The preparation of the dimer includes, for example, the dissolution of a suitable amount, such as about 1 part gallium chloride in a suitable amount of, for example, about 5 parts to about 15 parts of toluene at a suitable temperature of, for example, from about 20° C. to about 30° C. to form a solution of gallium chloride. Subsequently, the resulting gallium chloride solution is contacted with a suitable amount of, for example, from about 2 parts to about 4 parts of an alkali alkoxide like sodium methoxide at a suitable temperature of, for example, from about 20° C. to about 40° C. to form a gallium alkoxide like gallium methoxide. The gallium methoxide solution can then be contacted with a suitable amount of, for example, from about 2 parts to about 6 parts of a dicyano benzene selected in a suitable amount, such as for example, from about 5 parts to about 15 parts, of an alkylene glycol like ethylene glycol for each part of gallium methoxide formed. The reaction mixture is then heated at a suitable temperature of, for example, from about 185° C. to about 205° C. for a suitable period of, for example, from about 1 hour to about 3 hours to provide the alkoxy-bridged gallium phthalocyanine dimer pigment precursor 1,2-di(oxogallium phthalocyaninyl)ethane. The formed dimer precursor is then stirred for a suitable time period, such as for example from about 1 to about 3, and more specifically, about 2 hours, in an acid like sulfuric acid present in a suitable amount, such as for example, from about 25 weight parts to about 75 weight parts, and retaining the temperature of the solution at, for example, from about 40° C. to about 60° C. in air or under an inert atmosphere such as argon or nitrogen. The resulting pigment slurry is then acid pasted into an aqueous base solution like ammonium hydroxide selected in a suitable amount, such as for example, from about 50 to 100 weight parts, of ammonium hydroxide.

A mixed solvent system may be utilized to convert Type I HOGaPc to Type V HOGaPc, and which allows for a controlled conversion of Type I HOGaPc to Type V HOGaPc thereby yielding a more uniform Type V HOGaPc pigment with a preselected particle diameter size. The solvent system may include at least two of a polar aprotic solvent, an ester and/or a ketone solvent mixture. Suitable polar aprotic solvent, such as N,N-dimethylformamide, N-methylpyrrolidone, dimethylsulfoxide, acetonitril, and mixtures thereof, in combination with an ester, such as n-butyl acetate, ethyl acetate, and mixtures thereof and/or a ketone such as acetone, methyl ethyl ketone, methyl isobutyl ketone, combinations thereof, and the like. The resulting Type V HOGaPc possesses an X-ray diffraction pattern having major peaks at Bragg angles of 7.4, 10, 12.2, 16.8, 18.6, 24, 25.3, 26.8, 28.3, 32, 2θ (2θ±0.2°).

REFERENCES

There is illustrated in U.S. Pat. No. 7,037,631, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

Layered photoconductors have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound and an amine hole transport dispersed in an electrically insulating organic resin binder.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water; concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

U.S. Pat. No. 6,376,141, the disclosure of which is totally incorporated herein by reference, illustrates various compositions comprising combinations of phthalocyanine pigments including hydroxygallium phthalocyanine pigments. Additionally, for example, U.S. Pat. No. 6,713,220, the disclosure of which is totally incorporated herein by reference, discloses a method of preparing a Type V hydroxygallium phthalocyanine.

A number of titanyl phthalocyanines, or oxytitanium phthalocyanines, are suitable photogenerating pigments known to absorb near infrared light around 800 nanometers and may exhibit improved sensitivity compared to other pigments, such as, for example, hydroxygallium phthalocyanine. Generally, titanyl phthalocyanine is known to have five main crystal forms known as Types I, II, III, X, and IV. For example, U.S. Pat. Nos. 5,189,155 and 5,189,156, the disclosures of which are totally incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and Iv phthalocyanines. U.S. Pat. No. 5,153,094, the disclosure of which is totally incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

To obtain a titanyl phthalocyanine-based photoreceptor having high sensitivity to near infrared light, it is believed of value to control not only the purity and chemical structure of the pigment, as is generally the situation with organic photoconductors, but also to prepare the pigment in a certain crystal modification. Consequently, it is still desirable to provide a photoconductor where the titanyl phthalocyanine is generated by a process that will provide high sensitivity titanyl phthalocyanines.

The appropriate processes, especially as they relate to the preparation of titanyl phthalocyanines and hydroxygallium phthalocyanines, and components, such as the supporting substrates, the photogenerating pigments, the charge transport compounds, the resin binders, and the like, may be selected for the present disclosure in embodiments thereof.

SUMMARY

Disclosed are active single layered photoconductors with many of the advantages illustrated herein, such as extended lifetimes of service of, for example, about 2,500,000 imaging cycles; improved charge acceptance characteristics as compared, for example, to a similar member that is free of a metal oxide treated mixture as disclosed herein; excellent electronic characteristics; stable electrical properties; low image ghosting; low background and/or minimal charge deficient spots (CDS); resistance to charge transport layer cracking upon exposure to the vapor of certain solvents; excellent surface characteristics; improved wear resistance; compatibility with a number of toner compositions; the avoidance of or minimal imaging member scratching characteristics; consistent $V_r$ (residual potential) that is substantially flat or no change over a number of imaging cycles as illustrated by the generation of known PIDC (Photo-Induced Discharge Curve), and the like.

Additionally disclosed are flexible photoconductors comprised of a single active layer of a titanyl phthalocyanine photogenerating pigment, a resin binder, a metal oxide, and a chelating agent or additive, and in contact thereof an optional hole blocking layer comprised of metal oxides, phenolic resins, and optional phenolic compounds, and which phenolic compounds contain at least two, and more specifically, two to ten phenol groups or phenolic resins with, for example, a weight average molecular weight ranging from about 500 to about 3,000 permitting, for example, a hole blocking layer with excellent efficient electron transport which usually results in a desirable photoconductor low residual potential $V_{low}$ where the imaging members exhibit low background and/or minimal CDS; and the prevention of $V_r$ cycle up, caused primarily by photoconductor aging, for numerous imaging cycles

EMBODIMENTS

Aspects of the present disclosure relate to a photoconductor comprising a supporting substrate, and thereover a layer comprised of a photogenerating component of at least one of a titanyl phthalocyanine, such as Type IV, Type V titanylphthalocyanine, and the like prepared as illustrated herein, and a hydroxygallium phthalocyanine prepared as illustrated herein, and a charge transport component, optionally dispersed in a suitable polymer binder, and a metal oxide treated with a chelating agent of, for example, a tetrafluorodihydroxyanthraquinone; a photoconductive member with an active layer thickness of from about 1 to about 25, from 1 to about 20, or from 1 to about 10 microns; a xerographic imaging apparatus containing a charging component, a development component, a transfer component, and a fixing component, and wherein the apparatus contains a single layered photoconductive imaging member as illustrated herein; a photoconductor wherein the treated metal oxide is present in an amount of from about 0.1 to about 30 weight percent, or from about 1 to about 10 weight percent; a member wherein the active single layer contains a photogenerating pigment present in an amount of from about 10 to about 95 weight percent; a member wherein the active single layer contains an inactive polymer binder; a member wherein the binder is present in an amount of from about 50 to about 90 percent by weight, and wherein the total of all layer components is about 100 percent; a member wherein the active layer photogenerating pigment is a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the resinous binder is selected from the group consisting of known suitable polymers like polyesters, polyvinyl butyrals, polycarbonates, polystyrene-b-polyvinyl pyridine, and polyvinyl formals; an imaging member wherein the active single layer photogenerating pigment is a metal free phthalocyanine; an imaging member or photoconductor wherein the single layer charge transport compound comprises

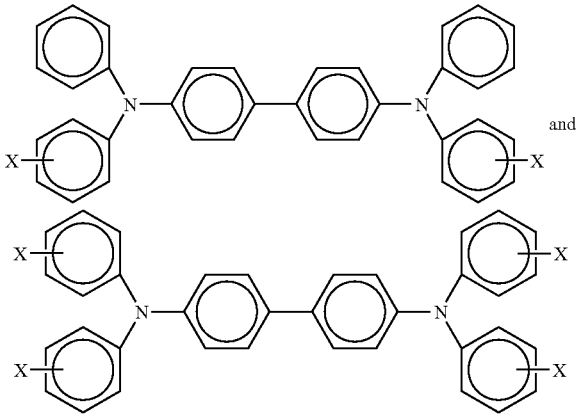

and wherein X is selected from the group consisting of alkyl, alkoxy, and halogen such as methyl and chloride; an imaging member wherein alkyl and alkoxy contain from about 1 to about 15 carbon atoms; an imaging member wherein alkyl contains from about 1 to about 5 carbon atoms; an imaging member wherein alkyl is methyl; a photoconductive member wherein the single layer charge transport compound comprises

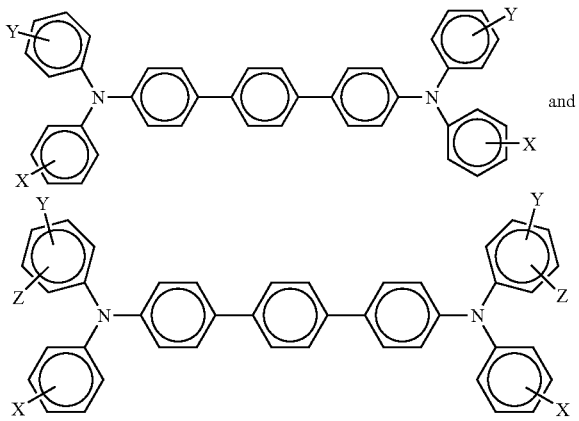

and wherein X, Y and Z are independently alkyl, alkoxy, aryl, a halogen, or mixtures thereof, and wherein at least one of Y and Z are present; wherein X and Y are independently alkyl, alkoxy, aryl, a halogen, or mixtures thereof wherein, for example, alkyl and alkoxy contain from about 1 to about 15 carbon atoms; alkyl contains from about 1 to about 5 carbon atoms; and wherein the resinous binder is selected from the group consisting of polycarbonates and polystyrene; a photoconductor wherein the single layer includes Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing the ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2θ+/−0.2°) 7.4, 9.8, 12.4, 16.2, 17.6, 18.4, 21.9, 23.9, 25.0, 28.1 degrees, and the highest peak at 7.4 degrees; a method of imaging wherein the imaging member is exposed to light of a wavelength of from about 400 to about 950 nanometers; a member wherein the single layer is of a thickness of from about 5 to about 25 microns; a member wherein the photogenerating component amount is from about 0.05 weight percent to about 20 weight percent, and wherein the photogenerating pigment is dispersed in from about 10 weight percent to about 80 weight percent of a polymer binder; a member wherein the thickness of the active layer is from about 1 to about 11 microns; a member wherein the photogenerating and charge transport components are contained in a polymer binder; a member wherein the binder is present in an amount of from about 50 to about 90 percent by weight, and wherein the total of the layer components is about 100 percent, and wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating component is Type V hydroxygallium phthalocyanine, or chlorogallium phthalocyanine, and the charge transport compound is a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, and wherein the resinous binder is selected from the group consisting of polycarbonates and polystyrene; a photoconductive imaging member with a blocking layer contained as a coating on a substrate, and an adhesive layer coated on the blocking layer; a color method of imaging which comprises generating an electrostatic latent image on the imaging member, developing the latent image, transferring and fixing the developed electrostatic image to a suitable substrate; and a single layer contained on a supporting substrate, and which layer comprises a mixture of a photogenerating pigment, a hole transport compound, a resin binder, and a metal oxide having attached thereto a chelating agent of a tetrafluorodihydroxyanthraquinone.

Examples of chelating compounds can be represented, for example, by

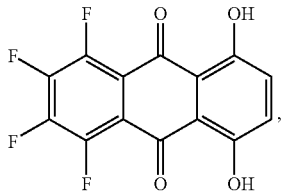

and more specifically, wherein the chelating compound is 1,2,3,4-tetrafluoro-5,8-dihydroxyanthraquinone (TFQ). Examples of chelating agents in addition to the TFQ include quinones, such as quinizarin and alizarin; amides, such as carboxamides (—$CONH_2$), sulfonamides (—$SO_2NH_2$), and the like. Examples of carboxamides include lactamide, glycolamide, succinamide, oxamide, formamide, acetamide, behenamide, 2,2-diethoxyacetamide, acrylamide, benzamide, glucuronamide, isonicotinamide, niacinamide, pyrazinecarboxamide, and diamide; examples of sulfonamides include 5-(dimethylamino)-1-naphthalenesulfonamide, and cyclopropanesulfonamide.

In embodiments, chelating agent examples are β-diketones such as acetyl acetone and 2,4-heptanedione; ketoesters such as methyl acetoacetate, ethyl acetoacetate, propyl acetoacetate, and butyl acetoacetate; hydroxylcarboxylic acids such as butyric acid, salicylic acid, and maleic acid; hydroxylcarboxylic acid esters such as methyl lactate, ethyl salicylate, and ethyl maleate; β-hydroxyketones or keto alcohols such as 4-hydroxy-4-methyl-2-pentanone; amino alcohols such as triethanolamine; and mixtures thereof.

Specific examples of chelating agents, which agents can function as an electron transport in embodiments, include quinone molecules such as alizarin and quinizarin; amide polymers and molecules such as lactamide, oxamide, succinamide, or mixtures thereof; and yet more specifically,

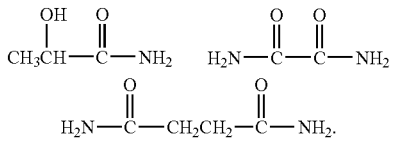

The β-hydroxyketones or β-diketones can be in the form of a polymer, or in the form of compounds or small molecules. Examples of small molecules are p-hydroxyketones or β-diketones, such as 4-hydroxy-4-methyl-2-pentanone, acetyl acetone, and ethyl acetoacetate, respectively,

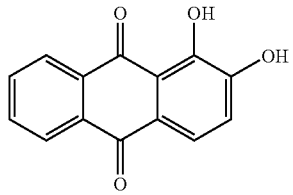

-continued

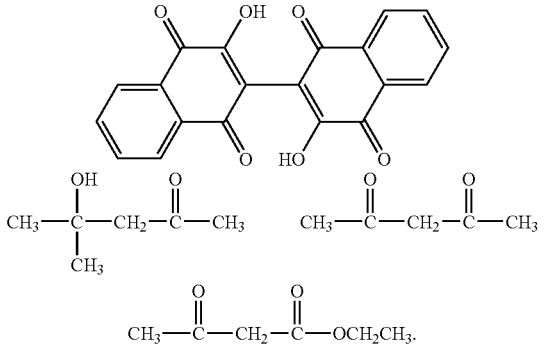

The ratio of the chelating agent to the metal oxide is from about 0.01 percent to 20 percent in weight, and more specifically, from about 0.1 to about 10 weight percent. In embodiments, the active layer further contains a polymer binder, and wherein the ratio of the photogenerating pigment to the metal oxide to the polymer to the chelating agent is from about 2/10/30/0.01 to about 5/40/50/5; wherein the active layer further contains a polymer binder, and wherein the ratio of the photogenerating pigment to the metal oxide to the polymer to the chelating agent to the charge transport component is from about 2/10/48/0.1/45 to about 5/40/40/5/10; wherein the ratio of the of the photogenerating pigment to the metal oxide to the chelating agent to the charge transport component is from about 2/10/0.1/45 to about 5/40/5/10. The chelating agent is in embodiments attached to the surface of the metal oxide as indicated, for example, by an absorption spectra change of the chelating agent.

Metal oxide examples include suitable metal oxides, such as known oxides of titanium, and more specifically, metal oxide examples are ZnO, $SnO_2$, $TiO_2$, $Al_2O_3$, $SiO_2$, $ZrO_2$, $In_2O_3$, $MoO_3$, and complex oxides of the above-mentioned metals thereof. The metal oxide in embodiments has, for example, a powder volume resistivity varying from about $10^4$ to about $10^{10}$ Ωcm at a 100 kilogram/cm$^2$ loading pressure, 50 percent humidity, and at room temperature. Also, the metal oxide like $TiO_2$ can be either surface treated or used untreated. Surface treatments include, but are not limited to, aluminum laurate, alumina, zirconia, silica, silane, methicone, dimethicone, sodium metaphosphate, and mixtures thereof. The amount of the metal oxide present in embodiments is, for example, from about 0.1 percent to about 80 percent in weight, and more specifically, from about 1 to about 40 weight percent.

Examples of $TiO_2$ include PT-401 M, available from Ishihara Sangyo Laisha, Ltd.; STR-60N™ (no surface treatment, and powder volume resistivity of approximately $9\times10^5$ Ωcm), available from Sakai Chemical Industry Co., Ltd.; FTL-100™ (no surface treatment, and powder volume resistivity of approximately $3\times10^5$ Ωcm), available from Ishihara Sangyo Laisha, Ltd.; STR-60™ ($Al_2O_3$ coated, and powder volume resistivity of approximately $4\times10^6$ Ωcm), available from Sakai Chemical Industry Co., Ltd.; TTO-55N™ (no surface treatment, and powder volume resistivity of approximately $5\times10^5$ Ωcm), available from Ishihara Sangyo Laisha, Ltd.; TTO-55A™ ($Al_2O_3$ coated, and powder volume resistivity of approximately $4\times10^7$ Ωcm), available from Ishihara Sangyo Laisha, Ltd.; MT-150W™ (sodium metaphosphate coated, and powder volume resistivity of approximately $4\times10^4$ Ωcm), available from Tayca; and MT-150AW™ (no surface treatment, and powder volume resistivity of approximately $1\times10^5$ Ωcm), available from Tayca.

The photogenerating pigment in embodiments is comprised of high photosensitivity titanyl phthalocyanines prepared as illustrated herein, and in copending application U.S. application Ser. No. 10/992,500, U.S. Publication No. 2006010524, the disclosure of which is totally incorporated herein by reference. In embodiments, the Type V phthalocyanine can be generated by dissolving Type I titanyl phthalocyanine in a solution comprising a trihaloacetic acid and an alkylene halide; adding the resulting mixture comprising the dissolved Type I titanyl phthalocyanine to a solution comprising an alcohol and an alkylene halide thereby precipitating a Type Y titanyl phthalocyanine; and treating the resulting Type Y titanyl phthalocyanine with monochlorobenzene.

With further respect to the titanyl phthalocyanines selected for the photogenerating layer, such phthalocyanines exhibit a crystal phase that is distinguishable from other known titanyl phthalocyanine polymorphs, and are designated as Type V polymorphs prepared by converting a Type I titanyl phthalocyanine to a Type V titanyl phthalocyanine pigment. The processes include converting a Type I titanyl phthalocyanine to an intermediate titanyl phthalocyanine, which is designated as a Type Y titanyl phthalocyanine, and then subsequently converting the Type Y titanyl phthalocyanine to a Type V titanyl phthalocyanine.

In one embodiment, the process comprises (a) dissolving a Type I titanyl phthalocyanine in a suitable solvent; (b) adding the solvent solution comprising the dissolved Type I titanyl phthalocyanine to a quenching solvent system to precipitate an intermediate titanyl phthalocyanine (designated as a Type Y titanyl phthalocyanine); and (c) treating the resultant Type Y phthalocyanine with a halo, such as, for example, monochlorobenzene to obtain a resultant high sensitivity titanyl phthalocyanine, which is designated herein as a Type V titanyl phthalocyanine. In another embodiment, prior to treating the Type Y phthalocyanine with a halo, such as monochlorobenzene, the Type Y titanyl phthalocyanine may be washed with various solvents including, for example, water, and/or methanol. The quenching solvents system to which the solution comprising the dissolved Type I titanyl phthalocyanine is added comprises, for example, an alkyl alcohol and an alkylene halide.

The process further provides a titanyl phthalocyanine having a crystal phase distinguishable from other known titanyl phthalocyanines. The titanyl phthalocyanine Type V prepared by a process according to the present disclosure is distinguishable from, for example, Type IV titanyl phthalocyanines in that a Type V titanyl phthalocyanine exhibits an X-ray powder diffraction spectrum having four characteristic peaks at 9.0°, 9.6°, 24.0°, and 27.2°, while Type IV titanyl phthalocyanines typically exhibit only three characteristic peaks at 9.6°, 24.0°, and 27.2°.

A number of Type I titanyl phthalocyanines may be selected for the generation of the Type V titanyl phthalocyanine, such as the Type 1s prepared as illustrated in U.S. Pat. Nos. 5,153,094; 5,166,339; 5,189,155; and 5,189,156, the disclosures of which are totally incorporated herein by reference.

More specifically, a Type I titanyl phthalocyanine may be prepared, in embodiments, by the reaction of $DI^3$ (1,3-diiminoisoindolene) and tetrabutoxide in the presence of 1-chloronaphthalene solvent, whereby there is obtained a crude Type I titanyl phthalocyanine, which is subsequently purified up to about a 99.5 percent purity by washing with, for example, dimethylformamide.

In another embodiment, for example, a Type I titanyl phthalocyanine can also be prepared by i) the addition of 1 part titanium tetrabutoxide to a stirred solution of from about 1 part to about 10 parts, and in embodiments about 4 parts of 1,3-diiminoisoindolene; ii) relatively slow application of heat using an appropriate sized heating mantle at a rate of about 1° per minute to about 10° per minute, and, in embodiments, about 5° per minute until refluxing occurs at a temperature of about 130° C. to about 180° C. (all temperatures are in Centigrade unless otherwise indicated); iii) removal and collection of the resulting distillate, which was shown by NMR spectroscopy to be butyl alcohol, in a dropwise fashion using an appropriate apparatus, such as a Claisen Head condenser, until the temperature of the reactants reaches from 190° C. to about 230° C., and in embodiments, about 200° C.; iv) continued stirring at the reflux temperature for a period of about ½ hour to about 8 hours, and in embodiments, about 2 hours; v) cooling of the reactants to a temperature of about 130° C. to about 180° C., and in embodiments, about 160° C. by removal of the heat source; vi) filtration of the flask contents through, for example, an M-porosity (10 to 15 microns) sintered glass funnel which was preheated using a solvent, which is capable of raising the temperature of the funnel to about 150° C., for example, boiling N,N-dimethylformamide in an amount sufficient to completely cover the bottom of the filter funnel so as to prevent blockage of said funnel; vii) washing the resulting purple solid by slurrying the solid in portions of boiling DMF either in the funnel or in a separate vessel in a ratio of about 1 to about 10, and preferably about 3 times the volume of the solid being washed, until the hot filtrate became light blue in color; viii) cooling and further washing the solid of impurities by slurrying the solid in portions of N,N-dimethylformamide at room temperature, about 25° C., approximately equivalent to about three times blue in color; ix) washing the solid of impurities by slurrying the solid in portions of an organic solvent, such as methanol, acetone, water and the like, and in this embodiment, methanol, at room temperature (about 25° C.) approximately equivalent to about three times the volume of the solid being washed until the filtrate became light blue in color; x) oven drying the purple solid in the presence of a vacuum, or in air at a temperature of from about 25° C. to about 200° C., and, in embodiments at about 70° C., for a period of from about 2 hours to about 48 hours, and in embodiments, for about 24 hours, thereby resulting in the isolation of a shiny purple solid, which was identified as being Type I titanyl phthalocyanine by its X-ray powder diffraction trace.

In still another embodiment, a Type I titanyl phthalocyanine may be prepared by (1) reacting a $DI^3$ with a titanium tetra alkoxide such as, for example, titanium tetrabutoxide at a temperature of about 195° C. for about two hours; (ii) filtering the contents of the reaction to obtain a resulting solid; (iii) washing the solid with dimethylformamide (DMF); (iv) washing with four percent ammonium hydroxide; (v) washing with deionized water; (vi) washing with methanol; (vii) reslurrying the washes and filtering; and (viii) drying at about 70° C. under vacuum to obtain a Type I titanyl phthalocyanine.

In a process embodiment for preparing a high sensitivity phthalocyanine in accordance with the present disclosure, a Type I titanyl phthalocyanine is dissolved in a suitable solvent. In embodiments, a Type I titanyl phthalocyanine is dissolved in a solvent comprising a trihaloacetic acid and an alkylene halide. The alkylene halide comprises, in embodiments, from about one to about six carbon atoms. An example of a suitable trihaloacetic acid includes, but is not limited to, trifluoroacetic acid. In one embodiment, the solvent for dissolving a Type I titanyl phthalocyanine comprises trifluoroacetic acid and methylene chloride. In embodiments, the trihaloacetic acid is present in an amount of from about one volume part to about 100 volume parts of the solvent, and the alkylene halide is present in an amount of from about one volume part to about 100 volume parts of the solvent. In one embodiment, the solvent comprises methylene chloride and trifluoroacetic acid in a volume-to-volume ratio of about 4 to 1. The Type I titanyl phthalocyanine is dissolved in the solvent by stirring for an effective period of time, such as, for example, for about 30 seconds to about 24 hours, at room temperature. The Type I titanyl phthalocyanine is dissolved by, for example, stirring in the solvent for about one hour at room temperature (about 25° C.). The Type I titanyl phthalocyanine may be dissolved in the solvent in either air or in an inert atmosphere (argon or nitrogen).

In embodiments, the Type I titanyl phthalocyanine is converted to an intermediate titanyl phthalocyanine form prior to conversion to the high sensitivity titanyl phthalocyanine pigment. "Intermediate" in embodiments refers, for example, that the Type Y titanyl phthalocyanine is a separate form prepared in the process prior to obtaining the final desired Type V titanyl phthalocyanine product. For example, to obtain the intermediate form, which is designated as a Type Y titanyl phthalocyanine, the dissolved Type I titanyl phthalocyanine is added to a quenching system comprising an alkyl alcohol, alkyl including, for example, carbon chain lengths of from about 1 to about 12 carbon atoms, and alkylene halides, such as an alkylene chloride. Adding the dissolved Type I titanyl phthalocyanine to the quenching system or quenching mixture causes the Type Y titanyl phthalocyanine to precipitate. Materials suitable as the alkyl alcohol component of the quenching system include, but are not limited to, methanol, ethanol, propanol, butanol, and the like. In embodiments, the alkylene chloride component of the quenching system comprises from about one to about six carbon atoms. In embodiments, the quenching system comprises methanol and methylene chloride. The quenching system comprises an alkyl alcohol to alkylene chloride ratio of from about 1/4 to about 4/1 (v/v). In other embodiments, the ratio of alkyl alcohol to alkylene chloride is from about 1/1 to about 3/1 (v/v). In an embodiment, the quenching system comprises methanol and methylene chloride in a ratio of about 1/1 (v/v). In another embodiment, the quenching system comprises methanol and methylene chloride in a ratio of about 3/1 (v/v). In embodiments, the dissolved Type I titanyl phthalocyanine is added to the quenching system at a rate of from about 1 milliliter/minute to about 100 milliliters/minute, and the quenching system is maintained at a temperature of from about 0° C. to about −25° C. during quenching. In a further embodiment, the quenching system is maintained at a temperature of from about 0° C. to about −25° C. for a period of from about 0.1 hour to about 8 hours after addition of the dissolved Type I titanyl phthalocyanine solution.

Following precipitation of the Type Y titanyl phthalocyanine, the precipitates may be washed with any suitable solution, including, for example, methanol, cold deionized water, hot deionized water, and the like. Generally, washing the precipitate will also be accompanied by filtration. A wet cake containing Type Y titanyl phthalocyanine and water is obtained with water content varying from about 30 to about 70 weight percent of the wet cake.

The Type V titanyl phthalocyanine is obtained by treating the obtained intermediate Type Y titanyl phthalocyanine with a halo, such as, for example, monochlorobenzene. The Type Y titanyl phthalocyanine wet cake may be redispersed in monochlorobenzene, filtered and oven-dried at a temperature of from about 60° C. to about 85° C. to provide the resultant Type V titanyl phthalocyanine. The monochlorobenzene treatment may occur over a period of about 1 hour to about 24 hours. In embodiments, the monochlorobenzene treatment is accomplished for a period of about five hours. Also, the Type V can be obtained as illustrated herein, and wherein a solvent mixture of tetrahydrofuran, about 40 weight percent, and monochlorobenzene, about 60 weight percent can be selected.

A titanyl phthalocyanine obtained in accordance with processes of the present disclosure, which is designated as a Type V titanyl phthalocyanine, exhibits an X-ray powder diffraction spectrum distinguishable from other known titanyl phthalocyanine polymorphs. A Type V titanyl phthalocyanine obtained exhibits in embodiments an X-ray diffraction spectrum having four characteristic peaks at 9.0°, 9.6°, 24.0°, and 27.2°. A titanyl phthalocyanine prepared by a process in accordance with the present disclosure may have a particle size diameter of from about 10 nanometers to about 500 nanometers. Particle size may be controlled or affected by the quenching rate when adding the dissolved Type I titanyl phthalocyanine to the quenching system and the composition of the quenching system.

The hydroxygallium photogenerating pigment can be prepared as illustrated herein, for example hydroxygallium phthalocyanine Type V essentially free of chlorine can be prepared from the pigment precursor Type I chlorogallium phthalocyanine by the reaction of gallium chloride in a solvent, such as N-methylpyrrolidone, present in an amount of from about 10 parts to about 100 parts, and more specifically, about 19 parts with 1,3-diiminoisoindolene ($DI^3$) in an amount of from about 1 part to about 10 parts, and more specifically, about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and more specifically about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and more specifically, about 24 hours.

In embodiments the hydroxygallium photogenerating pigment, such as Type V, can be prepared by the conversion of Type I hydroxygallium phthalocyanine wherein the Type I hydroxygallium phthalocyanine can be prepared by the hydrolysis of alkoxy-bridged gallium phthalocyanine dimer 1,2-di(oxogallium phthalocyaninyl)ethane. The preparation of the aforementioned dimer comprises the dissolution of about 2 parts gallium chloride in about 5 parts to about 15 parts of toluene at a temperature of from about 20° C. to about 30° C. to form a solution of gallium chloride. The gallium chloride solution can then be contacted with from about 2 parts to about 4 parts of a sodium methoxide at a temperature of from about 20° C. to about 45° C. to form gallium methoxide. Thereafter, the gallium methoxide solution can be contacted with, for example, about 2 parts to about 6 parts of dicyano benzene, and, for example, from about 5 parts to about 15 parts of ethylene glycol for each part of gallium methoxide formed; the reaction can occur at a temperature of, for example, from about 185° C. to about 205° C. for a period of, for example, about 1 hour to about 3 hours to provide the alkoxy-bridged gallium phthalocyanine dimer pigment precursor 1,2-di(oxogallium phthalocyaninyl)ethane. The dimer precursor is then stirred in an acid like sulfuric acid in an amount of from about 25 weight parts to about 75 weight parts for a suitable time period, such as from 1 to 4 hours, and more specifically 2 hours, while retaining the temperature of the solution of from 40 to about 60° C. in air or under an inert atmosphere such as argon or nitrogen. The resulting pigment slurry is then acid pasted into an aqueous ammonium hydroxide solution of an amount of about 50 to 100 weight parts of ammonium hydroxide.

A mixed solvent system may be utilized to convert the obtained Type I HOGaPc to Type V HOGaPc. The mixed solvent system of the present disclosure allows for a controlled conversion of Type I HOGaPc to Type V HOGaPc, which yields a more uniform Type V HOGaPc pigment with a uniform crystal size and consistent structure. The ratio amounts between solvents can be adjusted for a proper conversion rate so that the optimum or desired particle size and crystal structure can be obtained. The solvent system may include at least two of a polar aprotic solvent, an ester and/or a ketone where the weight ratio between the polar aprotic solvent and the ester or ketone is, for example, from about 10 to about 90, and more specifically, from about 25 to about 75 percent by weight. Suitable polar aprotic solvent examples are N,N-dimethylformamide, N-methylpyrrolidone, dimethylsulfoxide, acetonitrile, and mixtures thereof; suitable second solvent is an ester or a ketone together with a second solvent, such as an ester like n-butyl acetate, ethyl acetate, combinations thereof, and the like, and/or a ketone, such as acetone, methyl ethyl ketone, methyl isobutyl ketone, combinations thereof, and the like. The resulting Type V HOGaPc possesses an X-ray diffraction pattern having major peaks at Bragg angles of 7.4, 10, 12.2, 16.8, 18.6, 24, 25.3, 26.8, 28.3, 32, 2θ) (2θ±0.2°).

The thickness of the substrate layer depends on many factors, including economical considerations, electrical characteristics, and the like, thus this layer may be of substantial thickness, for example over 3,000 microns, such as from about 300 to about 700 microns, or of a minimum thickness. In embodiments, the thickness of this layer is from about 100 microns to about 500 microns, or from about 100 microns to about 150 microns.

The substrate may be opaque or substantially transparent, and may comprise any suitable material. Accordingly, the substrate may comprise a layer of an electrically nonconductive or conductive material, such as an inorganic or an organic composition. As electrically nonconducting materials, there may be employed various resins known for this purpose, including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors including strength desired and economical considerations. For a drum, as disclosed in a copending application referenced herein, this layer may be of substantial thickness of, for example, up to many centimeters or of a minimum thickness of less than a millimeter. Similarly, a flexible belt may be of substantial thickness of, for example, about 250 micrometers, or of minimum thickness of less than about 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent, comprise a layer of insulating material including inorganic or organic polymeric materials, such as MYLAR® a commercially available polymer, MYLAR® containing titanium, a layer of an organic or inorganic material having a semiconductive surface layer, such as indium tin oxide or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example, polycarbonate materials commercially available as MAKROLON®.

In embodiments, examples of polymeric binder materials that can be selected as the matrix for the active layer are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylsilanols, polyarylsulfones, polybutadienes, polysulfones, polysilanolsulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers. Specific examples of polymer binder materials of value are polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene) carbonate (also referred to as bisphenol-A-polycarbonate), poly(4,4'-cyclohexylidinediphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000 preferred. Generally, the transport layer contains from about 10 to about 75 percent by weight of the charge transport material, and more specifically, from about 35 percent to about 50 percent of this material.

The photogenerating pigment is present in the resinous binder composition in various amounts. Generally, however, from about 5 percent by weight to about 90 percent by weight of the photogenerating pigment is dispersed in about 10 percent by weight to about 95 percent by weight of the resinous binder, or from about 20 percent by weight to about 50 percent by weight of the photogenerating pigment is dispersed in about 80 percent by weight to about 50 percent by weight of the resinous binder composition. In one embodiment, about 50 percent by weight of the photogenerating pigment is dispersed in about 50 percent by weight of the resinous binder composition.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As optional adhesive layers usually in contact with or situated between the hole blocking layer and the active layer, there can be selected various known substances inclusive of copolyesters, polyamides, poly(vinyl butyral), poly(vinyl alcohol), polyurethane, and polyacrylonitrile. This layer is, for example, of a thickness of from about 0.001 micron to about 1 micron, or from about 0.1 micron to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layer for the photoconductors of the present disclosure can contain a number of components including known hole blocking components, such as amino silanes, doped metal oxides, TiSi, a metal oxide like titanium, chromium, zinc, tin and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer in contact with the substrate and situated between the substrate and the active layer can be, for example, comprised of from about 20 weight percent to about 80 weight percent, and more specifically, from about 55 weight percent to about 65 weight percent of a suitable component like a metal oxide, such as $TiO_2$; from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. The optional hole blocking layer may be applied to the substrate.

Charge transport components and molecules present in the single layer include a number of known materials, such as aryl amines, and more specifically molecules of the following formula

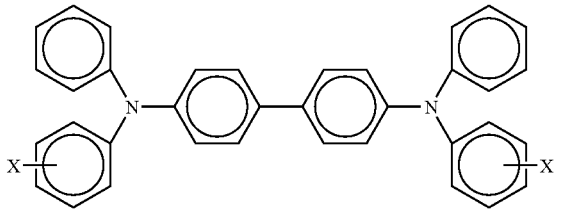

wherein X is alkyl, alkoxy, aryl, a halogen, or mixtures thereof, and especially those substituents selected from the group consisting of Cl and $CH_3$; and molecules of the following formula

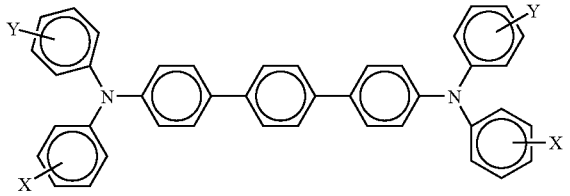

wherein X and Y are independently alkyl, alkoxy, aryl, a halogen, or mixtures thereof.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport molecules can be selected, reference for example, U.S. Pat. Nos. 4,921,773 and 4,464,450, the disclosures of which are totally incorporated herein by reference.

Examples of charge transporting molecules, especially when there is selected a polymer or resin binder, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine; hydrazones such as N-phenyl-N-methyl-3-(9-ethyl)carbazyl hydrazone, and 4-diethyl amino benzaldehyde-1,2-diphenyl hydrazone; and oxadiazoles, such as 2,5-bis(4-N,N'-diethylaminophenyl)-1,2,4-oxadiazole, stilbenes, and the like. However, in embodiments, to minimize or avoid cycle-up in equipment, such as printers, with high throughput, the charge transport layer should be substantially free (less than about two percent) of di or triamino-triphenyl methane.

Examples of components or materials optionally incorporated into the single layer to, for example, enable improved lateral charge migration (LCM) resistance include hindered phenolic antioxidants, such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Company, Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Company, Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules, such as bis(4-diethylamino-2-methylphenyl) phenylmethane (BDETPM), bis-[2-methyl-4-(N-2-hydroxyethyl-N-ethyl-aminophenyl)]-phenylmethane (DHTPM), and the like. The weight percent of the antioxidant is from about 0 to about 20, from about 1 to about 10, or from about 3 to about 8 weight percent.

The following Examples are provided.

Example I

To a 1 liter round bottomed flask were added 25 grams of gallium chloride and 300 milliliters of toluene, and the mixture was stirred for 10 minutes to form a solution. Then, 98 milliliters of a 25 weight percent sodium methoxide solution (in methanol) were added while cooling the flask with an ice bath to keep the contents below 40° C. Subsequently, 250 milliliters of ethylene glycol and 72.8 grams of o-phthalodinitrile were added. The methanol and toluene were quickly distilled off over 30 minutes while heating from 70° C. to 135° C., and then the phthalocyanine synthesis was performed by heating at 195° C. for 4.5 hours. The resulting alkoxy-bridged gallium phthalocyanine dimer was isolated by filtration at 120° C. The product was then washed with 400 milliliters DMF at 100° C. for 1 hour and filtered. The resulting product was then washed with 600 milliliters of deionized water at 60° C. for 1 hour and filtered. The product was then washed with 600 milliliters of methanol at 25° C. for 1 hour and filtered. The product was dried at 60° C. under vacuum for 18 hours. The alkoxy-bridged gallium phthalocyanine dimer, 1,2-di(oxogallium phthalocyaninyl)ethane, was isolated as a dark blue solid in 77 percent yield. The dimer product was characterized by elemental analysis, infrared spectroscopy, H NMR spectroscopy, and X-ray powder diffraction. Elemental analysis showed the presence of only 0.10 percent chlorine. Infrared spectroscopy: major peaks at 573, 611, 636, 731, 756, 775, 874, 897, 962, 999, 1,069, 1,088, 1,125, 1,165, 1,289, 1,337, 1,424, 1,466, 1,503, 1,611, 2,569, 2,607, 2,648, 2,864, 2,950, and 3,045 $cm^{-1}$; $^1H$ NMR spectroscopy (TFA-d/CDCl solution, 1:1 v/v, tetramethylsilane reference): peaks at (8 ppm±0.01 ppm) 4.00 (4H), 8.54 (16H), and 9.62 (16H); X-ray powder diffraction pattern: peaks at Bragg angles (2θ±0.2 degree) of 6.7, 8.9, 12.8, 13.9, 15.7, 16.6, 21.2, 25.3, 25.9, and 28.3 with the highest peak at 6.7 degrees 2θ.

The hydrolysis of the above prepared alkoxy-bridged gallium phthalocyanine dimer was performed as follows. Sulfuric acid (94 to 96 percent, 125 grams) was heated to 40° C. in a 125 milliliter Erlenmeyer flask, and then 5 grams of the alkoxy-bridged gallium phthalocyanine dimer, 1,2-di(oxogallium phthalocyaninyl)ethane solid were added. Addition of the solid was completed in approximately 15 minutes, during which time the temperature of the solution increased to about 48° C. The resulting acid solution was then stirred for 2 hours at 40° C., after which the solution resulting was added in a dropwise fashion to a mixture comprised of concentrated (−30 percent) ammonium hydroxide (265 milliliters) and deionized water (435 milliliters), which had been cooled to a temperature of below about 5° C. The addition of the dissolved phthalocyanine was completed in approximately 30 minutes, during which time the temperature of the solution increased to about 40° C. The reprecipitated phthalocyanine was then removed from a cooling bath and allowed to stir at room temperature, about 25° C. for 1 hour. The resulting phthalocyanine was then filtered through a porcelain funnel fitted with a Whatman 934-AH grade glass fiber filter forming a blue solid, which was redispersed in fresh deionized water by stirring at room temperature for 1 hour and filtered as before. This process was repeated at least three times until the conductivity of the filtrate was <20 mu·S. The filter cake obtained was oven dried overnight, about 18 hours, at 50° C. to give 4.75 grams (95 percent) of Type I HOGaPc, identified by infrared spectroscopy and X-ray powder diffraction. Infrared spectroscopy: major peaks at 507, 573, 629, 729, 756, 772, 874, 898, 956, 984, 1,092, 1,121, 1,165, 1,188, 1,290, 1,339, 1,424, 1,468, 1,503, 1,588, 1,611, 1,757, 1,835, 1,951, 2,099, 2,207, 2,280, 2,384, 2,425, 2,570, 2,608, 2,652, 2,780, 2,819, 2,853, 2,907, 2,951, 3,049 and 3,479 (broad); X-ray diffraction pattern: peaks at Bragg angles of 6.8, 13.0, 16.5, 21.0, 26.3 and 29.5 with the highest peak at 6.8 degrees 2θ (2θ+/−0.2 degree).

The Type I hydroxygallium phthalocyanine pigment obtained (3 grams) was then added to 25 milliliters of N,N-dimethylformamide in a 60 milliliter glass bottle containing 60 grams of glass beads (0.25 inch in diameter). The bottle was sealed and placed on a ball mill overnight (18 hours). The solid formed was isolated by filtration through a porcelain funnel fitted with a Whatman GF/F grade glass fiber filter, and washed in the filter using several 25 milliliter portions of acetone. The filtered wet cake was oven dried overnight, about 18 hours, at 50° C. to provide 2.8 grams of Type V HOGaPc (hydroxygallium phthalocyanine) which was identified by infrared spectroscopy and X-ray powder diffraction. Infrared spectroscopy: major peaks were at 507, 571, 631, 733, 756, 773, 897, 965, 1,067, 1,084, 1,121, 1,146, 1,165, 1,291, 1,337, 1,425, 1,468, 1,503, 1,588, 1,609, 1,757, 1,848, 1,925, 2,099, 2,205, 2,276, 2,384, 2,425, 2,572, 2,613, 2,653, 2,780, 2,861, 2,909, 2,956, 3,057 and 3,499 $cm^{-1}$; X-ray diffraction pattern: peaks were at Bragg angles of 7.4, 9.8, 12.4, 12.9, 16.2, 18.4, 21.9, 23.9, 25.0 and 28.1 with the highest peak at 7.4 degrees 2θ (2θ+/−0.2 degree).

Comparative Example 1

A photoconductor was prepared by providing a 0.02 micrometer thick titanium layer coated on a biaxially oriented polyethylene naphthalate substrate (KALEDEX™ 2000) having a thickness of 3.5 mils, and applying thereon, with a gravure applicator, a solution containing 50 grams of 3-amino-propyltriethoxysilane, 41.2 grams of water, 15 grams of acetic acid, 684.8 grams of denatured alcohol, and 200 grams of heptane. This layer was then dried for about 5 minutes at 135° C. in the forced air dryer of the coater. The resulting blocking layer had a dry thickness of 500 Angstroms.

An active combined single photoconductive/charge transport layer was then prepared and deposited on the above substrate/hole blocking layer, and which layer contained a photogenerating pigment, a charge transport compound, and a resin binder generated as follows:

The photogenerating pigment dispersion was prepared by introducing 0.45 gram of poly(4,4'-diphenyl-1,1'-cyclohexane carbonate) cyclohexyl polycarbonate IUPILON™ Z-500, a known polycarbonate weight average molecular weight of 50,000, available from Mitsubishi Gas Chemical Corporation, and 50 milliliters of tetrahydrofuran into a 4 ounce glass bottle. To this solution were added 2.4 grams of the above prepared hydroxygallium phthalocyanine (Type V) and 300 grams of ⅛ inch (3.2 millimeters) diameter stainless steel shot. This mixture was then placed on a ball mill for 8 hours. Subsequently, 2.25 grams of PCZ-500 were dissolved in 46.1 grams of tetrahydrofuran, and added to the hydroxygallium phthalocyanine (Type V) dispersion. The resulting dispersion was then filtered with a 40 μm Nylon cloth filter and to the filtrate was added a charge transport compound generated by introducing into an amber glass bottle in a weight ratio of 1:1 3.3 grams of N,N'-diphenyl-N,N'-bis(3-methylphenyl)-1,1'-biphenyl-4,4'-diamine, and MAKROLON 5705®, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids.

Thereafter, the above formed mixture was applied to the above prepared substrate/hole blocking layer with a Bird applicator to form the active layer having a thickness of 5 microns. A strip about 10 millimeters wide along one edge of the substrate bearing the blocking layer was deliberately left uncoated to facilitate adequate electrical contact by the ground strip layer that was applied later.

The above prepared total photoconductor thickness was 31.4 μm as measured by an Eddy current thickness gauge or a permascope.

The pigment dispersion can also be prepared by the milling of 1.3 kilograms of the above prepared hydroxygallium phthalocyanine Type V pigment particles and 867 grams of a vinylchloride and vinyl acetate copolymer (VMCH), available from Union Carbide in 10.67 kilograms of N-butylacetate and 5.3 kilograms of xylene with 45 kilograms of 1 millimeter diameter zirconium oxide balls for from about 36 to about 72 hours. The resulting milled sample was then filtered with a 20 micrometer pore size Nylon filter and 15.3 kilograms of the dispersion were extracted. Then the resulting charge generation dispersion was further diluted with an additional solvent of 12.9 kilograms of xylene and 5.5 kilograms of butylacetate. Separately, a charge transport solution was prepared by mixing 5.5 grams of poly(4,4'-diphenyl-1,1'-cyclohexane carbonate), obtained from Mitsubishi Chemicals, with 4.4 grams of N,N'-diphenyl-N,N'-bis(methylphenyl)-1,1-biphenyl-4,4'-diamine, and 31.2 grams of tetrahydrofuran and 7.8 grams of toluene. This mixture was rolled in a glass bottle until the solids were dissolved.

Example II

A photoconductor was prepared by repeating the process of Comparative Example 1 except that the active negatively charged single combined layer was prepared as follows.

3.3 Grams of PT-401M $TiO_2$ and about 0.07 gram of 1,2,3,4-tetrafluoro-5,8-dihydroxyanthraquinone (TFQ) were mixed in 50.78 grams of THF/monochlorobenzene at 40/60 weight ratio for about 2 hours. The color of the mixture changed from dark yellow to dark red, an indication that the quinone was attached to the $TiO_2$ surface. Then 6.34 grams of the above known polycarbonate POLYCARBONATE PCZ™ (PCZ500) and 130 grams of 0.4 to 0.6 millimeter of $ZrO_2$/$SiO_2$ beads were added, and the mixture was milled/stirred for 6 hours at 130 rpm. Subsequently, 0.26 gram of hydroxygallium phthalocyanine (Type V) obtained per the process above, was added and milling was continued overnight, about 18 to about 21 hours, at about 80 rpm. The weight ratio among the materials was OHGaPC/$TiO_2$/PCZ500/TFQ=2/25/48/0.5. The dispersion resulting was then filtered with a 40 μm Nylon cloth and 3.3 grams of N,N'-bis(methylphenyl)-1,1-biphenyl-4,4'-diamine, was added to the filtrate, and dissolved followed by coating the mixture resulting on the substrate/hole blocking layer. The thickness of the resulting single layered photoconductor was about 34.5 μm as measured by an Eddy current thickness gauge or a permascope.

Comparative Example 2

A photoconductor was prepared by repeating the process of Example I except that the active single layer was prepared using an electronic transport molecule instead and no $TiO_2$, and no chelating agent as follows.

3.3 Grams of carboxylfluorenone malonitrile (BCFM), a known electron transport molecule, were mixed in 46.8 grams of THF/toluene at 70/30 weight ratio for about 2 hours. Then, 6.34 grams of poly(4,4'-diphenyl-1,1'-cyclohexane carbonate) IUPILON™ Z-500, weight average molecular weight of 50,000, available from Mitsubishi Gas Chemical Corporation, 0.26 gram of hydroxygallium phthalocyanine Type V, and 130 grams of 0.4 to 0.6 millimeter $ZrO_2$/$SiO_2$ beads were added to the resulting mixture followed by milling for 18 hours at 80 rpm. The weight ratio among the materials was TiOPC/BCFM/PCZ500=2/25/48. The dispersion was then filtered with 40 μm Nylon cloth and 3.3 grams of N,N'-bis(methylphenyl)-1,1-biphenyl-4,4'-diamine were added to the filtrate and dissolved followed by coating on the substrate/hole the blocking layer of the above Comparative Example I. The thickness of the single layer photoconductor (includes the substrate) was about 28 μm as measured by an Eddy current thickness gauge.

Electrical Property Testing

The above prepared photoconductors were tested in a scanner set to obtain negatively charged photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant negative voltage charging at various surface potentials.

As compared to the photoconductors of Comparative Examples 1 and 2, the photoconductor of Example I possessed a number of improved characteristics as determined by the generation of known negative charging PIDC curves, and more specifically the Example I photoconductor evidenced improved charge acceptance, as indicated by a higher surface potential voltage at the same level of charging for the Example I photoconductor, than the Comparative Examples 1 and 2 photoconductors.

Without the TFQ doping, the Comparative Example 1 and 2 photoconductors could only be charged to about 300 Volts even as the Vscreen of the scorotron was set at close to 800 volts. In contrast, $V_{high}$ of about 555 volts was achieved for the Example I single layer photoconductor with 0.5 percent TFQ doping.

The photosensitivity for the Example I TFQ doped single layer photoconductor was about 430 $Vcm^2$/ergs at negative charging, while the Comparative Example 1 photoconductor photosensitivity was about 396 $Vcm^2$/ergs. While not being desired to be limited by theory, it is believed that the high sensitivity to photoinduced dark decay for the photoconductor of Example I results from the use of the TFQ chelating agent.

Also, the photoconductor of Example I permitted, for example, developed electrostatic images with excellent resolutions and substantially no undesirable background deposits.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a supporting substrate, and an active layer in contact with said substrate, and which layer is comprised of at least one photogenerating pigment of a hydroxygallium phthalocyanine, at least one charge transport component, and a mixture of a metal oxide and a chelating agent of an anthraquinone, and wherein said phthalocyanine is prepared by hydrolyzing a gallium phthalocyanine precursor pigment by dissolving said gallium phthalocyanine in a strong acid, and then reprecipitating the resulting dissolved pigment in basic aqueous media; concentrating the resulting aqueous slurry comprised of water and hydroxygallium phthalocyanine to a wet cake; removing water from said slurry by azeotropic distillation with an organic solvent; and subjecting said resulting hydroxygallium phthalocyanine pigment slurry to mixing with the addition of a second solvent, wherein said anthraquinone is a tetrafluorodihydroxyanthraquinone; and wherein the ratio of said hydroxygallium phthalocyanine pigment to said metal oxide to said chelating agent to said charge transport component is from about 2/10/0.1/45 to about 5/40/5/10.

2. A photoconductor in accordance with claim 1 wherein said hydroxygallium phthalocyanine is generated by the hydrolysis of a 1,2-di(oxogallium phthalocyaninyl)ethane in an acid, and subsequently acid pasting the resulting mixture in an aqueous ammonium oxide solution thereby precipitating a Type I hydroxygallium phthalocyanine, and mixing said Type I hydroxygallium phthalocyanine with at least one of a polar aprotic solvent and an ester or a ketone, and wherein said active layer further contains a polymer binder, and wherein the ratio of said hydroxygallium phthalocyanine to said metal oxide to said polymer to said chelating agent is from about 2/10/30/0.01 to about 5/40/50/5, and wherein said charge transport component is present in an amount of from about 5 to about 50 weight percent.

3. A photoconductor in accordance with claim 1 wherein the azeotropic water removal is accomplished by dispersing a wet cake comprised of Type I hydroxygallium phthalocyanine formed in a hydrophobic organic solvent followed by heating to reflux; removing any water formed; refluxing until the boiling point of the reaction mixture reaches that of the hydrophobic organic solvent; cooling and filtering the dispersion formed; dispersing the resulting precipitate in N,N-dimethylformamide; and stirring for from about 16 to about 48 hours whereby conversion to Type V hydroxygallium phthalocyanine results.

4. A photoconductor in accordance with claim 1 wherein the sulfur content of said pigment slurry is reduced from about 3,000 to about 5,000 parts per million to from about 50 to about 100 parts per million by solvent washing of the pigment slurry containing Type V hydroxygallium phthalocyanine by dispersing in an organic solvent selected from the group consisting of N,N-dimethylformamide, acetone, N,N-dimethylpyrrolidone, tetrahydrofuran, methanol, and isopropanol; adding to the resulting dispersion concentrated ammonium hydroxide solution; and stirring for from about 2 to about 18 hours; followed by further washing with deionized water until the conductivity of the filtrate decreases to below about 20 $mS/cm^{-1}$.

5. A photoconductor in accordance with claim 1 wherein said chelating agent is present on the surface of said metal oxide.

6. A photoconductor in accordance with claim 1 wherein said chelating agent is attached to said metal oxide surface.

7. A photoconductor in accordance with claim 1 wherein said chelating agent is

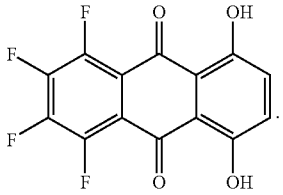

8. A photoconductor in accordance with claim 1 wherein said charge transport component is

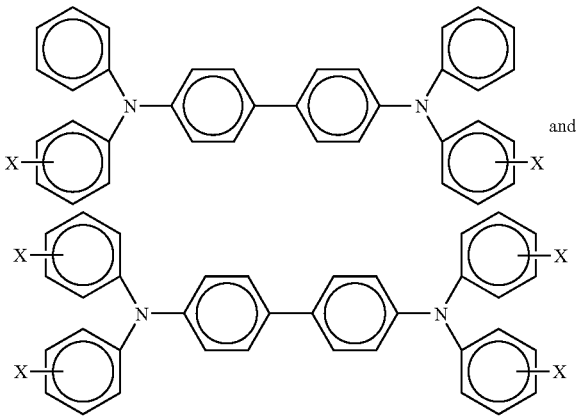

and wherein X is selected from the group comprised of alkyl, alkoxy, aryl, and halogen.

9. A photoconductor in accordance with claim 8 wherein said alkyl and said alkoxy each contains from about 1 to about 12 carbon atoms, and said aryl contains from about 6 to about 36 carbon atoms.

10. A photoconductor in accordance with claim 8 wherein said charge transport component is aryl amine of N,N'-diphenyl-N,N-bis(3-methylphenyl)-1,1'-biphenyl-4,4'-diamine, and said substrate is present.

11. A photoconductor in accordance with claim 1 wherein said charge transport component is comprised of at least one of

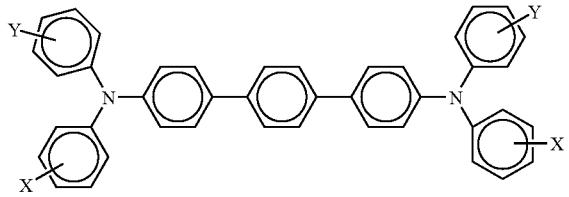

wherein X and Y are independently selected from the group comprised of alkyl, alkoxy, aryl, and halogen; and

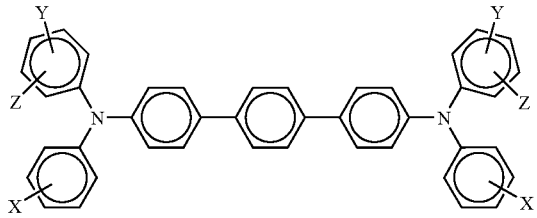

wherein X, Y and Z are independently alkyl, alkoxy, aryl, a halogen, or mixtures thereof.

12. A photoconductor in accordance with claim 11 wherein alkyl and alkoxy each contains from about 1 to about 12 carbon atoms, and aryl contains from about 6 to about 36 carbon atoms, and said substrate is present.

13. A photoconductor in accordance with claim 1 wherein said charge transport component is an aryl amine selected from the group consisting of at least one of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine.

14. A photoconductor in accordance with claim 1 wherein said active layer further contains a polymer binder, and wherein the ratio of said photogenerating pigment to said metal oxide to said polymer to said chelating agent to said charge transport component is from about 2/10/48/0.1/45 to about 5/40/40/5/10.

15. A photoconductor in accordance with claim 1 wherein the obtained hydroxygallium phthalocyanine is Type V hydroxygallium phthalocyanine, and the ratio of said phthalocyanine to said metal oxide to said chelating agent to said charge transport component is from about 2/10/0.1/45 to about 5/40/5/10.

16. A photoconductor in accordance with claim 1 wherein the obtained hydroxygallium phthalocyanine is Type V, and wherein said phthalocyanine is formed into dispersion with a polycarbonate binder, and a solvent mixture of tetrahydrofuran and a monohalobenzene followed by adding thereto said charge transport component.

17. A photoconductor in accordance with claim 1 wherein there results hydroxygallium phthalocyanine Type V, wherein said phthalocyanine is formed into dispersion with a resin binder, and a solvent mixture of tetrahydrofuran and a monohalobenzene, and wherein said tetrahydrofuran is present in an amount of from about 30 to about 50 weight percent, and said monochlorobenzene is present in an amount of from about 70 to about 50 weight percent followed by adding thereto said charge transport component.

18. A photoconductor in accordance with claim 1 wherein there results hydroxygallium phthalocyanine Type V, wherein said phthalocyanine is formed into dispersion with a polycarbonate binder, and a solvent mixture of tetrahydrofuran and a monohalobenzene, and wherein said tetrahydrofuran is present in an amount of about 40 to about 60 weight percent, and said monochlorobenzene is present in an amount of about 60 to about 40 weight percent, and wherein the total thereof is about 100 weight percent followed by adding thereto said charge transport component.

19. A photoconductor in accordance with claim 1 further including a hole blocking layer, and an adhesive layer.

20. A negatively charging single layer photoconductor comprised of a layer of a hydroxygallium phthalocyanine which is prepared by hydrolyzing a halogallium phthalocyanine; and a charge transport compound, a polymer binder, and a mixture of a metal oxide and a chelating agent, wherein said chelating agent is a tetrafluorodihydroxyanthraquinone, wherein said metal oxide is at least one of ZnO, $SnO_2$, $TiO_2$, $Al_2O_3$, $SiO_2$, $ZrO_2$, $In_2O_3$, and $MoO_3$, and said hydroxygallium phthalocyanine is Type V, and wherein the ratio of said phthalocyanine pigment to said metal oxide to said chelating agent to said charge transport component is from about 2/10/0.1/45 to about 5/40/5/10.

21. A photoconductor in accordance with claim 20 wherein said chelating agent is 1,2,3,4-tetrafluoro-5,8-dihydroxyanthraquinone, said halogallium is chlorogallium, and said hydroxygallium phthalocyanine is Type V.

22. A photoconductor in accordance with claim 20 wherein said metal oxide is titanium dioxide, and said hydroxygallium phthalocyanine is Type V.

23. A photoconductor in accordance with claim 1 wherein said metal oxide is at least one of ZnO, $SnO_2$, $TiO_2$, $Al_2O_3$, $SiO_2$, $ZrO_2$, $In_2O_3$, and $MoO_3$.

24. A photoconductor in accordance with claim 1 wherein said metal oxide is $TiO_2$.

25. A photoconductor in accordance with claim 1 wherein the substrate is comprised of a conductive material.

26. A photoconductor in accordance with claim 20 wherein said chelating agent is

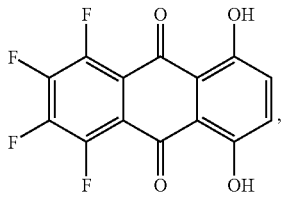

* * * * *